US007669441B2

(12) United States Patent
Zeleny

(10) Patent No.: US 7,669,441 B2
(45) Date of Patent: Mar. 2, 2010

(54) FINISHING NEEDLE

(76) Inventor: Ann D. Zeleny, 7501 Overlook Dr., Boonsboro, MD (US) 21713

( * ) Notice: Subject to any disclaimer, the term of this patent is extended or adjusted under 35 U.S.C. 154(b) by 0 days.

(21) Appl. No.: 12/219,926

(22) Filed: Jul. 30, 2008

(65) Prior Publication Data

US 2010/0024488 A1 Feb. 4, 2010

(51) Int. Cl.
*D04B 3/02* (2006.01)

(52) U.S. Cl. ..... 66/117

(58) Field of Classification Search ..... 66/1 R, 66/1 A, 1.5, 2, 116–118
See application file for complete search history.

(56) References Cited

U.S. PATENT DOCUMENTS

| | | | | | |
|---|---|---|---|---|---|
| 1,091,395 | A | * | 3/1914 | Sencenbaugh | 66/118 |
| 1,477,427 | A | * | 12/1923 | Christensen | 66/118 |
| 1,611,474 | A | | 12/1926 | Mathews | |
| 2,117,143 | A | * | 5/1938 | Burger | 66/117 |
| 2,217,524 | A | | 10/1940 | Neuschwanger et al. | |
| 2,271,477 | A | | 1/1942 | Davis | |
| D133,543 | S | | 8/1942 | Megarry | |
| 2,364,649 | A | | 12/1944 | Palliser | |
| 2,538,635 | A | * | 1/1951 | Wahle | 66/117 |
| 2,601,769 | A | * | 7/1952 | Visconti | 66/118 |
| 2,748,579 | A | * | 6/1956 | Sornin de Leysat | 66/1 A |
| 3,322,085 | A | | 5/1967 | Weiss | |
| D269,734 | S | | 7/1983 | Okada | |
| 6,397,640 | B1 | | 6/2002 | Williams | |
| D567,438 | S | * | 4/2008 | Srivastava | D28/10 |
| D567,439 | S | * | 4/2008 | Srivastava | D28/10 |

FOREIGN PATENT DOCUMENTS

| | | |
|---|---|---|
| FR | 2639658 | 6/1990 |
| JP | 62276059 | 11/1987 |

OTHER PUBLICATIONS

Harmony Wood 6" Double Pointed Needle Set Us Sizes 0-3. http://www.knitpicks.com/Harmony+Wood+6+Double+Pointed+Needle+Set+US+Sizes+0-3_ND90307.html, p. 1 of 4 printed from the Internet on Feb. 8, 2008.

* cited by examiner

*Primary Examiner*—Danny Worrell
(74) *Attorney, Agent, or Firm*—Richard C. Litman

(57) ABSTRACT

The finishing needle is a hand sewing tool used for weaving loose ends of yarn back into a hand-knitted item when finishing a knitting work. The finishing needle is a long needle with two ends that taper to a semi-point at each end. The needle has a single eye that extends through the length of the needle. The eye has a beveled edge that provides for easier threading and to hold the yarn securely. The finishing needle can weave loose ends of yarn into a knitted item when finishing without stopping to turn the needle around, and with no need to re-thread, when weaving in the opposite direction. The finishing needle can more easily make use of shorter lengths of yarn than a conventional needle or hook, and can finish a large knitted item or one with multiple colors much faster than with a conventional needle.

4 Claims, 11 Drawing Sheets

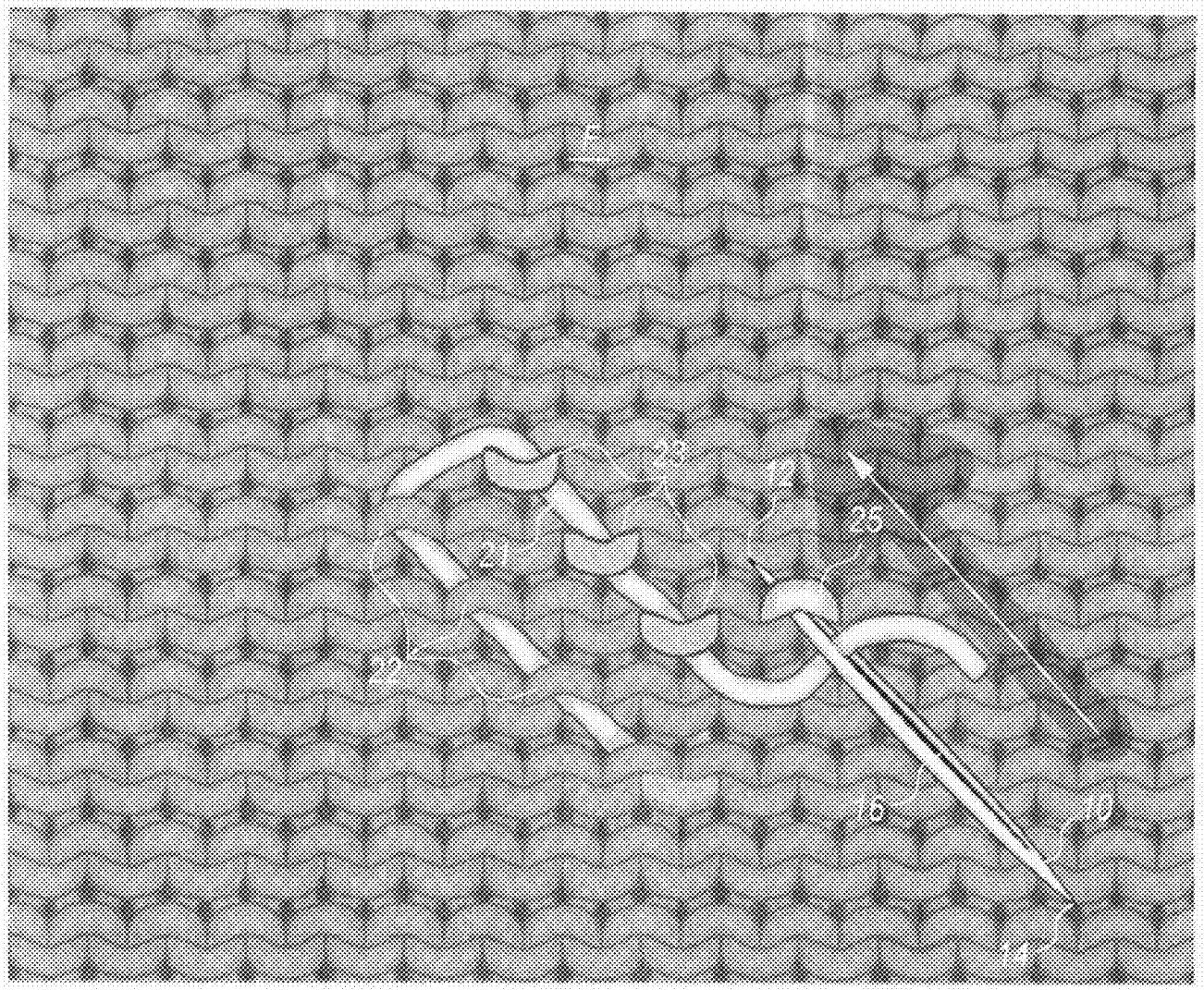
14
12
16
18
20
22
24
26
28
30
32
34
36
38
40
42
44
46
48
50
52
54
56
58
60
62
64
66
68
70
72
74
76
78
80
82
84
86
88
90
92
94

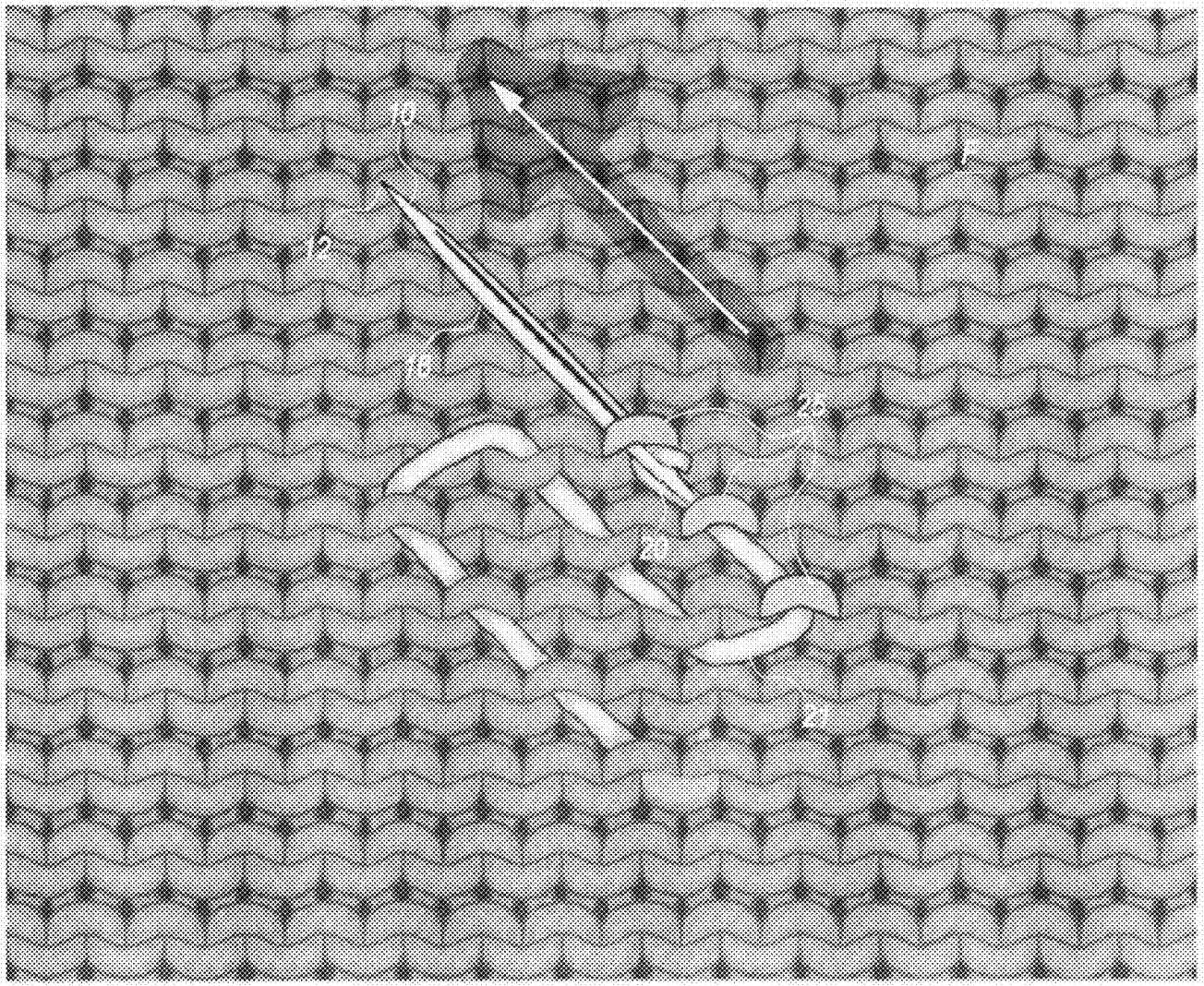
F
R
R
R

FINISHING NEEDLE

BACKGROUND OF THE INVENTION

1. Field of the Invention

The present invention relates to sewing needles, and more particularly to a finishing needle for use with yarn or other like materials for weaving ends of yarn back into a knitted item when finishing the work.

2. Description of the Related Art

Knitting is a technique for producing a two-dimensional fabric from a one-dimensional yarn or thread. In weaving, the threads are always straight, running parallel either lengthwise (warp threads) or crosswise (weft threads). By contrast, the yarn in knitted fabrics follows a meandering path (a course), forming symmetric loops symmetrically above and below the mean path of the yarn. These meandering loops can be stretched easily in different directions, which gives knitting much more elasticity than woven fabrics; depending on the yarn and knitting pattern, knitted garments can stretch as much as five hundred percent. For this reason, knitting was initially developed for garments that must be elastic or stretch in response to the wearer's motions, such as socks and hosiery.

For comparison, woven garments stretch mainly along one direction (the bias) and not very much, unless they are woven from stretchable material such as Lycra. Knitted garments are often more formfitting than woven garments, since their elasticity allows them to follow the body's curvature closely. By contrast, curvature is introduced into most woven garments only with sewn darts, flares, gussets and gores, the seams of which lower the elasticity of the woven fabric still further. Extra curvature can be introduced into knitted garments without seams, as in the heel of a sock. The effect of darts and flares can be obtained with short rows or by increasing or decreasing the number of stitches. The thread used in weaving is usually much finer than the yarn used in knitting, which can make the knitted fabric bulkier and have less drape than a woven fabric.

If they are not secured, the loops of a knitted course will come undone when their yarn is pulled. This is known as ripping out or unraveling knitting. To secure a stitch, at least one new loop is passed through it. Although the new stitch is itself unsecured ("active"), it secures the stitches suspended from it. A sequence of stitches in which each stitch is suspended from the next is called a wale. To secure the initial stitches of a knitted fabric, a method for casting on is used. To secure the final stitches in a wale, one uses a method of binding off. During knitting, the active stitches are secured mechanically, either from individual hooks in the case of knitting machines, or from a knitting needle or frame in hand knitting.

The process of knitting involves holding the active stitches so that the stitches do not drop, releasing the stitches after they are secured and passing new bights of yarn through the fabric, usually through active stitches. In very simple cases, knitting can be done without tools, using only the fingers to do these tasks. However, knitting is usually carried out using instruments, such as knitting needles, knitting machines or rigid frames. Other accessories are used to prepare yarn for knitting, to measure and design knitted garments, or to make knitting easier or more comfortable.

The knitting project must be "finished." Finishing is the process of weaving ends of the yarn back into the project. If not done correctly, the yarn can unravel and cause the knitted item to fall apart, or cause a weak or uncomfortable spot on the item that leads to premature wear.

For every knitting project it is necessary to weave in at least two ends when finishing the work; the excess yarn at the cast on edge and the excess yarn at the bound off edge. More complicated or larger projects, such as blankets or multi colored or striped sweaters, may have many end pieces of yarn that must be woven back into the work.

Items that are commonly used by knitters to weave the loose ends of yarn back into the project are darning needles and crochet hooks. Darning needles are similar to sewing needles except that they are larger and have a larger eye. Darning needles work effectively to weave the ends of the yarn back into the project. When weaving in the ends, at least two changes of direction are needed to secure most kinds of yarn. However, when the yarn pieces become short, each change of direction can require re-threading the needle. This process can be very tedious, especially when working with large numbers of yarn ends. Crochet hooks are often used, but they can snag the intervening rows of stitches, and are no less tedious to use with a large number of yarn ends. There is a need, therefore, for a finishing needle that can be used to quickly and efficiently weave in a large number of yarn ends with minimal turning and re-threading. Thus, a finishing needle solving the aforementioned problems is desired.

SUMMARY OF THE INVENTION

The finishing needle is a sewing tool used for weaving loose ends of yarn or like threaded materials back into a hand-knitted item when finishing knitting work or other hand-sewn items. The finishing needle is a long needle with two ends that taper to a semi-point at each end. The needle has a single, elongated eye that extends through the length of the needle. The eye has a beveled edge that provides for easier threading and for holding the yarn securely. The finishing needle can weave loose ends of yarn into a knitted item when finishing without stopping to re-thread the needle or to turn the needle around when weaving in the opposite direction. The needle can make easy use of shorter lengths of yarn than a conventional needle or hook, and can finish a large knitted item or one with multiple colors much faster than a conventional needle.

The finishing needle may be manufactured from a variety of materials, such as wood, steel, plastic or bamboo, and may be made in a variety of sizes to accommodate different types and thickness of yarn. These and other features of the present invention will become readily apparent upon further review of the following specification and drawings.

BRIEF DESCRIPTION OF THE DRAWINGS

FIGS. 4A, 4B, 4C, 4D, 4E, 4F, 4G, 4H, 4I, and 4J illustrate sequential views of a method for using the finishing needle according to the present invention.

Similar reference characters denote corresponding features consistently throughout the attached drawings.

DETAILED DESCRIPTION OF THE PREFERRED EMBODIMENT

The present invention relates to sewing needles, and more particularly, to a finishing needle with a single, elongated eye for weaving loose ends of yarn or like threaded material back into a knitted item, or other sewn work, when finishing the work.

Figure 1:
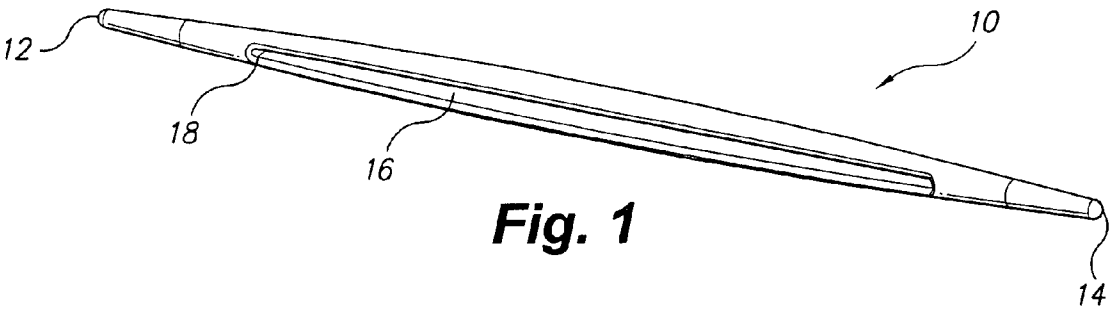
FIG. 1 is a perspective view of a finishing needle according to the present invention.

FIG. 1 is a perspective view of a finishing needle 10 that tapers to a first end 12 and second end 14. The first end 12 and second end 14 each have a semi-pointed or rounded shape. The finishing needle 10 has a single eye 16 between the first end 12 and the second end 14 that extends substantially the entire length of the finishing needle 10.

Figure 2:
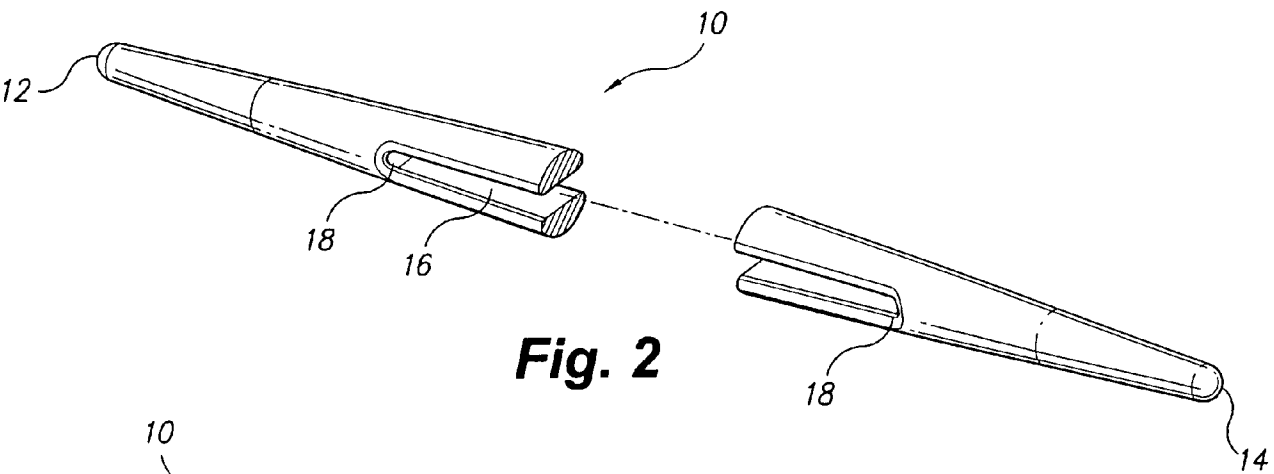
FIG. 2 is an exploded view of a finishing needle according to the present invention.

FIG. 2 is an exploded view of the finishing needle 10, showing the beveled edge 18 of the eye 16. Although the finishing needle 10 resembles a double-pointed knitting needle, it should be understood that the needle 10 is a hand-sewing needle, and is not a knitting needle.

Figure 3:
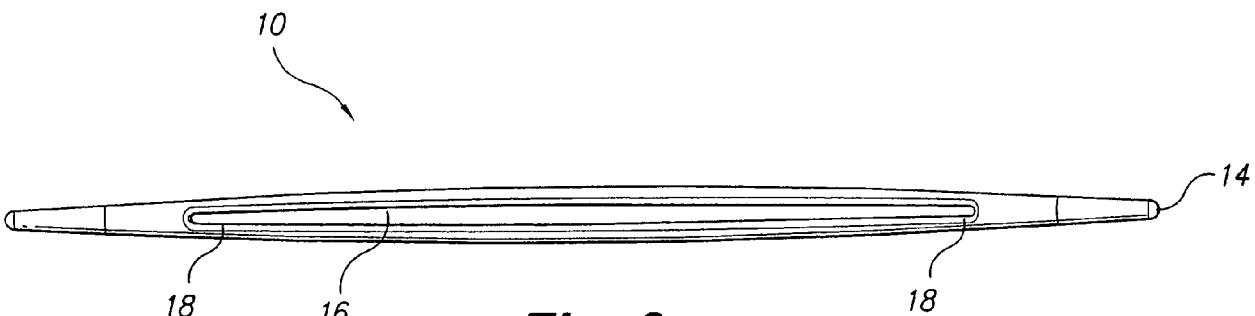
FIG. 3 is a side view of a finishing needle according to the present invention.

FIG. 3 is a side view of the finishing needle 10, showing the eye 16 extending substantially the length of the finishing needle 10.

Figure 4A:
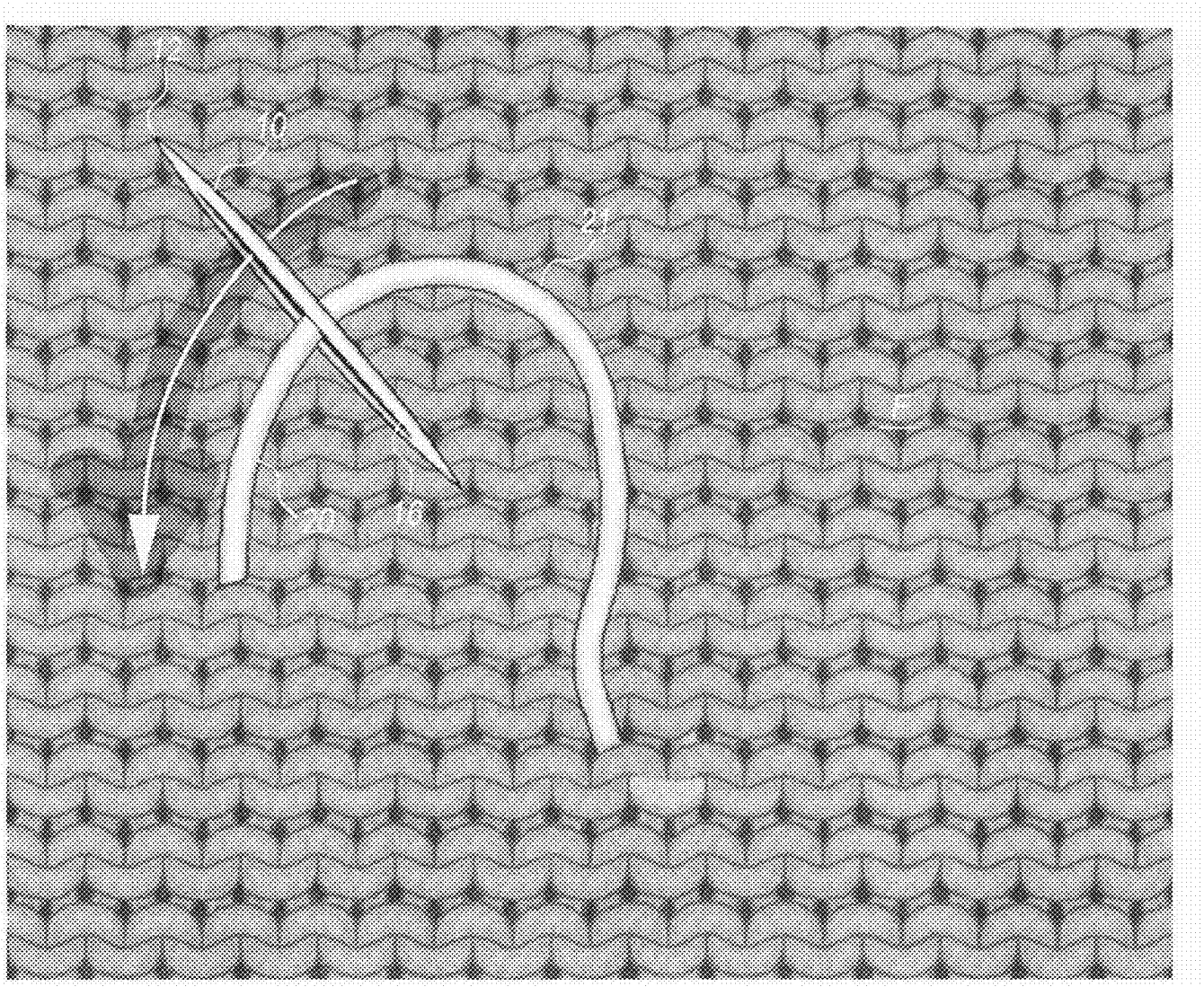
Figure 4B:
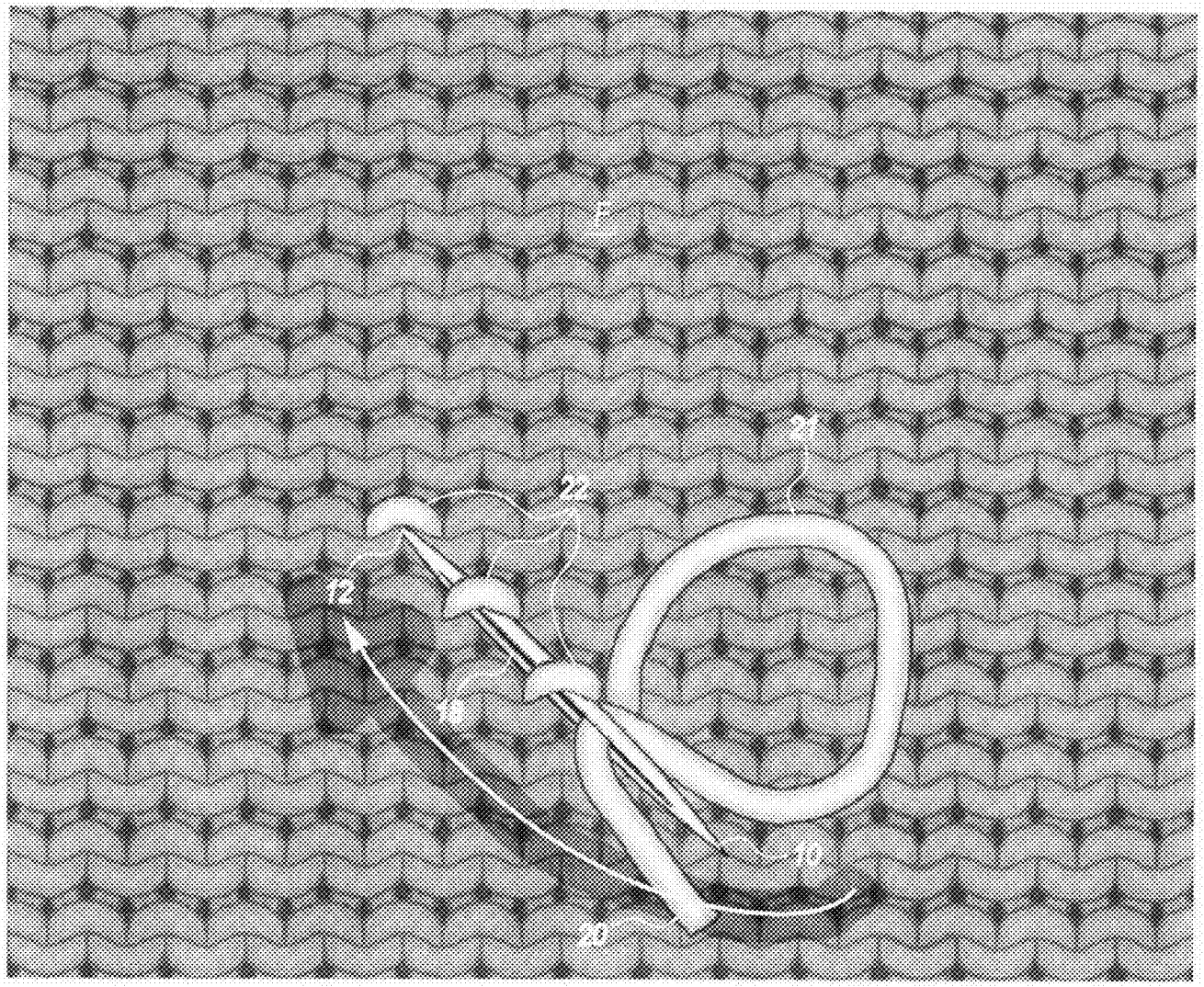
Figure 4C:
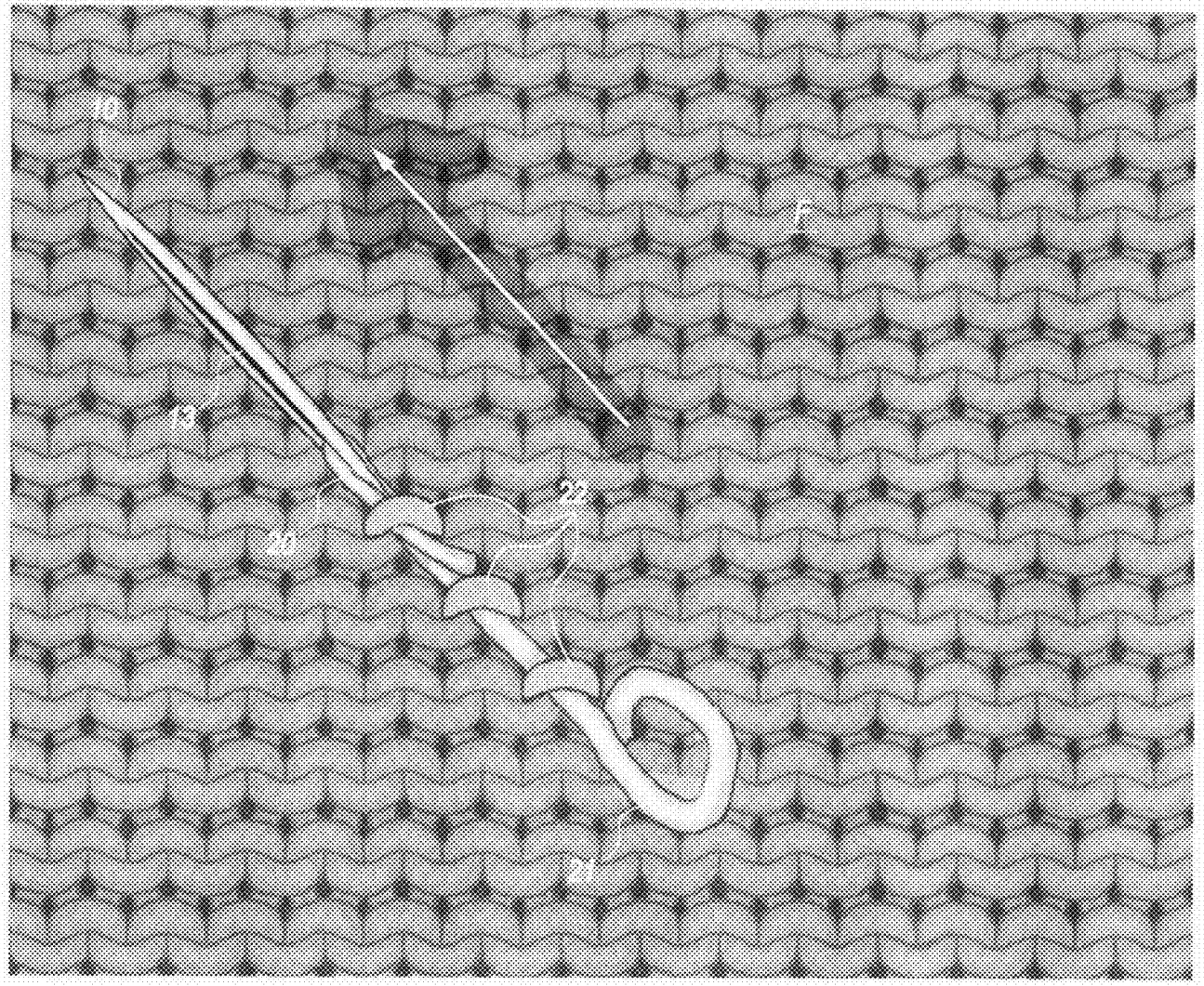
Figure 4D:
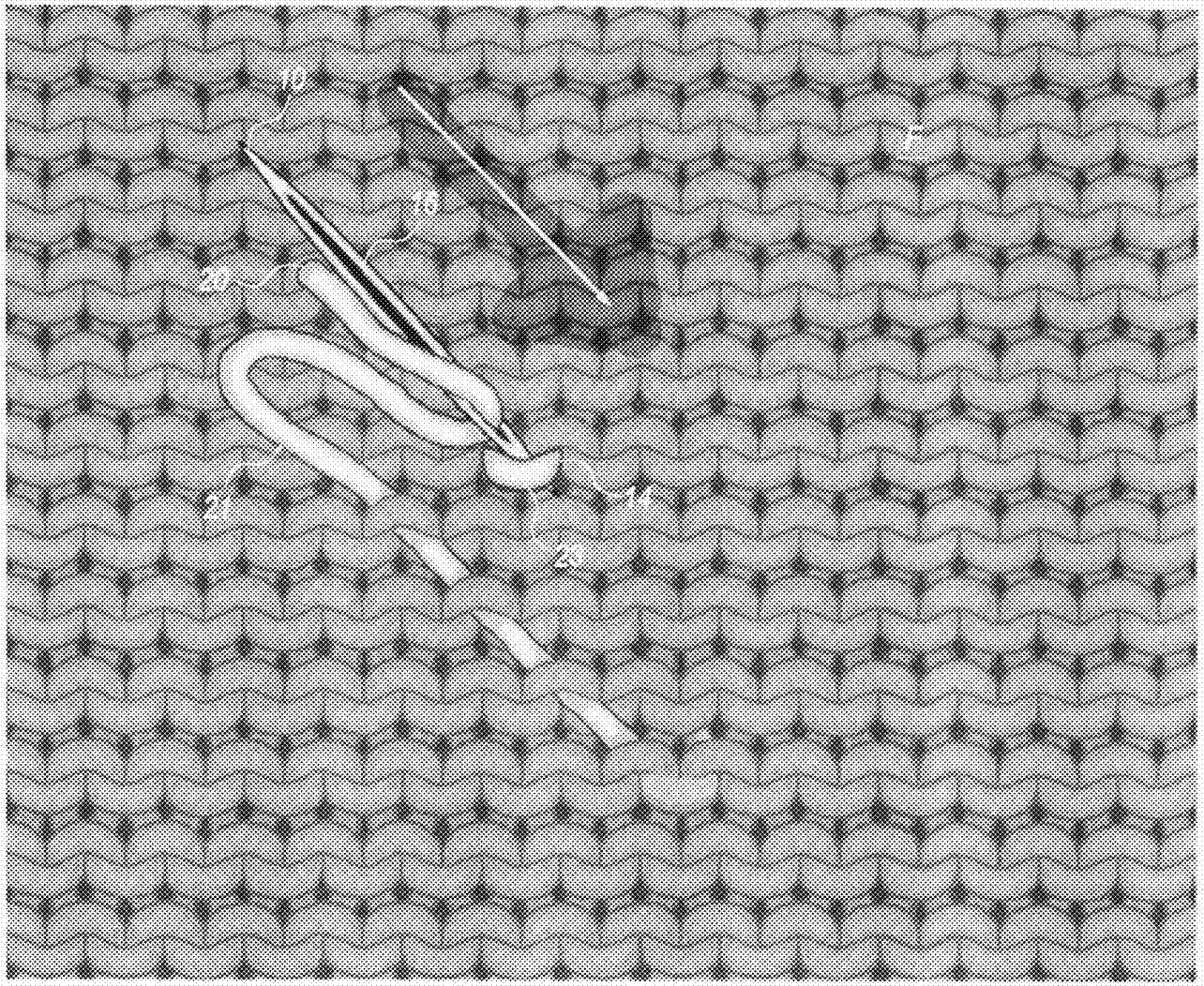

FIGS. 4A-4J illustrate a method of using the finishing needle 10 to weave in the loose yarn when finishing a knitting project. In FIG. 4A, starting with the rear face of the piece of knitted fabric F facing upwardly, the loose end 20 of a piece of yarn 21 is threaded into the eye 16 of the finishing needle 10. Next, in FIG. 4B, the finishing needle 10 is passed under the threads 22 of fabric piece F in the direction of the front end 12. In FIG. 4C, the finishing needle 10 then pulls the loose end 20 of yarn 21 out the opposite side of the threads 22. Next, in FIG. 4D, without turning the needle 10 around, needle 10 is passed under a different set of threads 23 in the direction of the back end 14 of the needle 10.

Figure 4E:
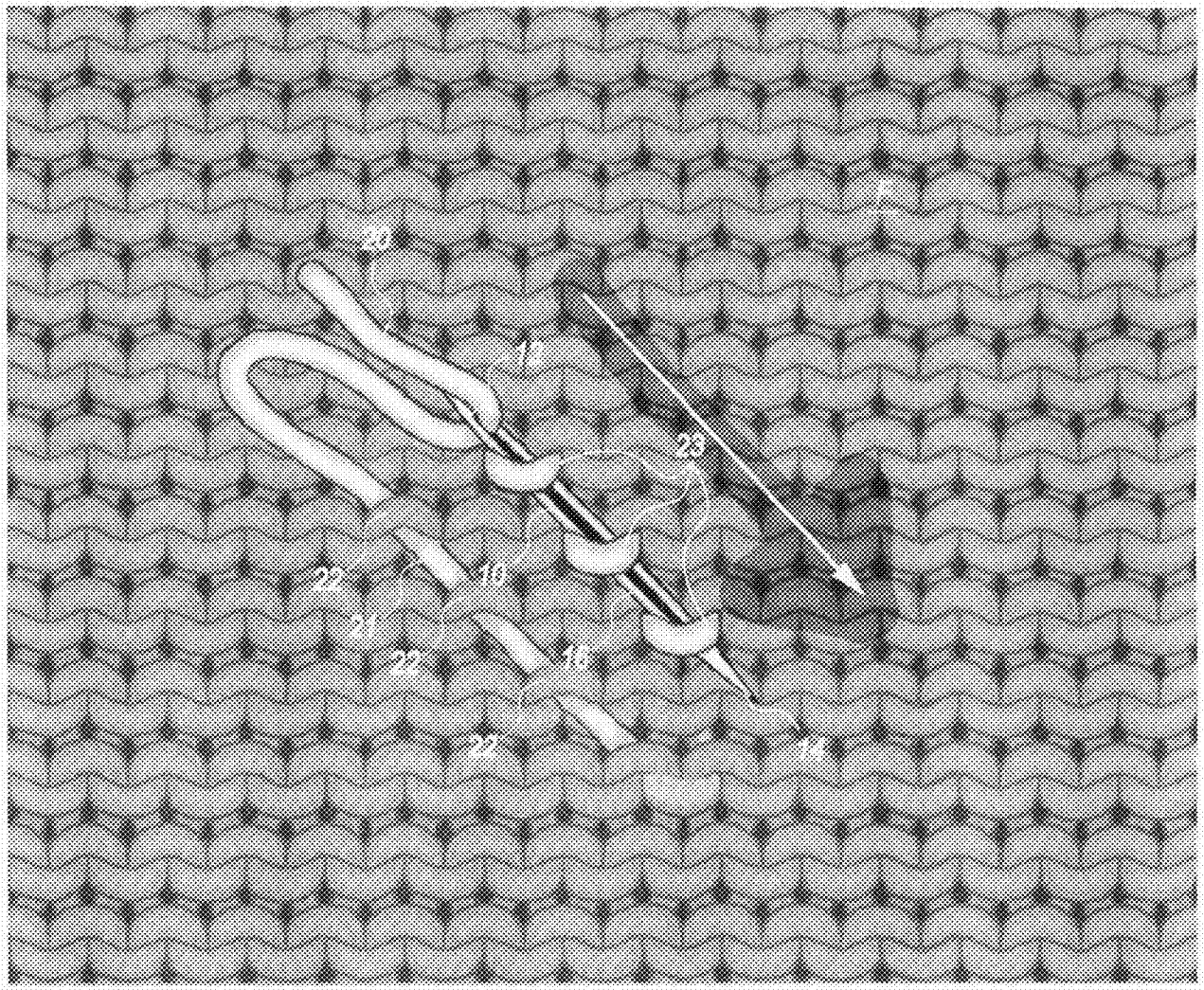
Figure 4F:
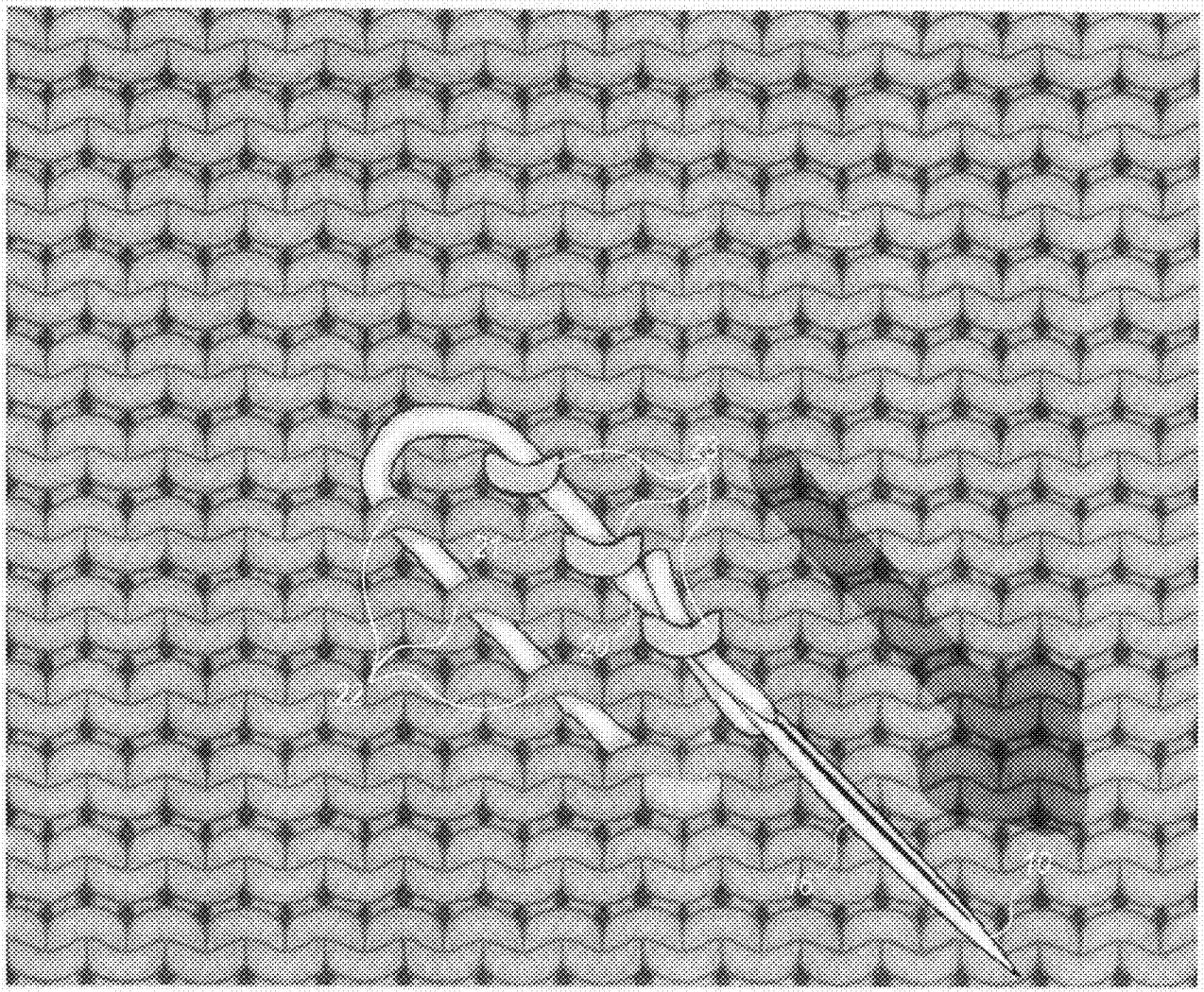
Figure 4H:
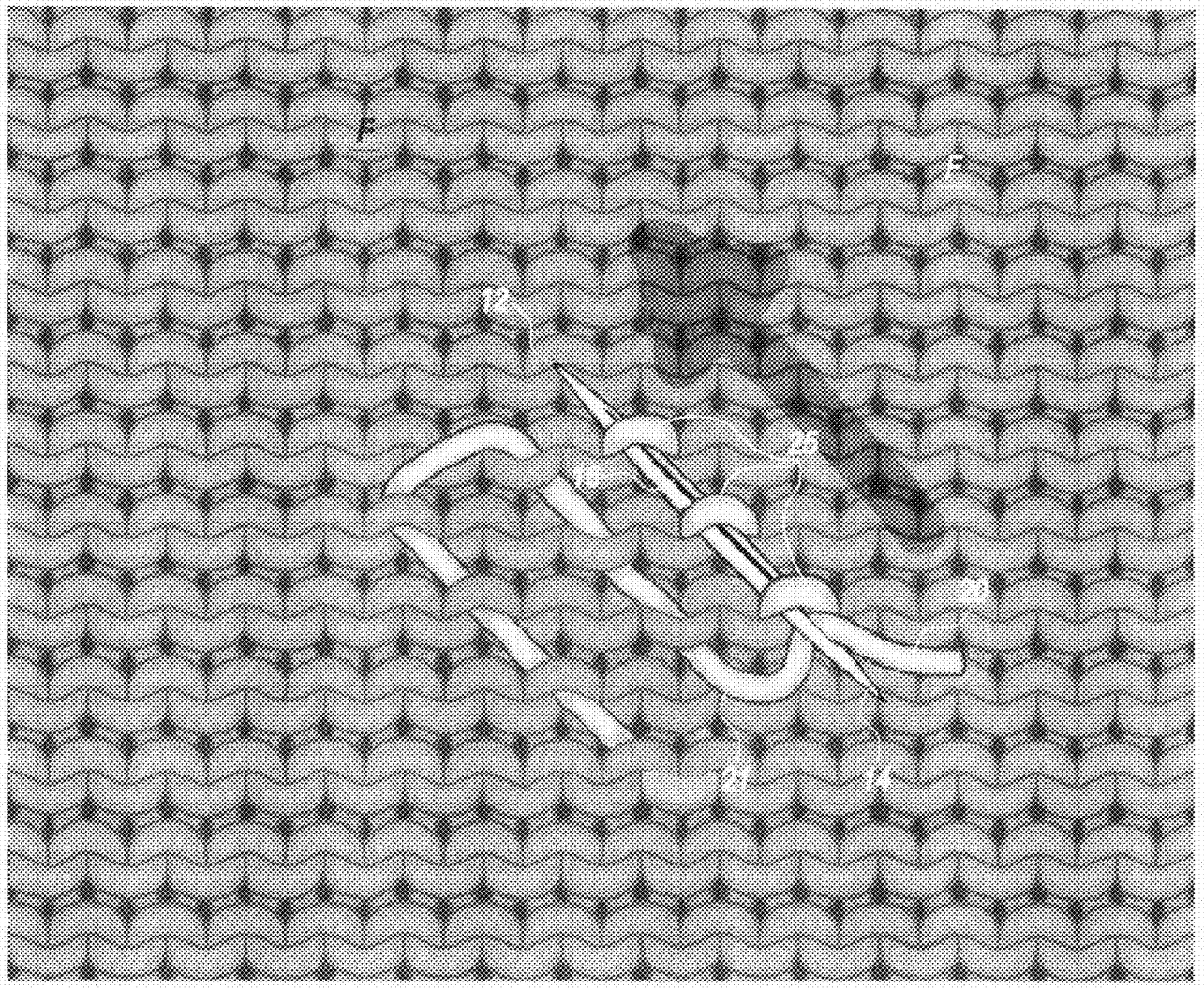

In FIG. 4E, the loose end 20 slides within the eye 16 to the trailing end of the eye 16 (adjacent end 12 of needle 10) as the finishing needle 10 passes under threads 23. In FIG. 4F, the finishing needle 10 pulls the loose end 20 out from under the threads 23. Next, in FIG. 4G, once again without turning needle 10 around, the finishing needle 10 is again passed under another set of threads 25 in the direction of front end 12. In FIG. 4H, the loose end 20 slides to the trailing end of eye 16 (adjacent back end 14) as finishing needle 10 passes under threads 25.

Figure 4J:
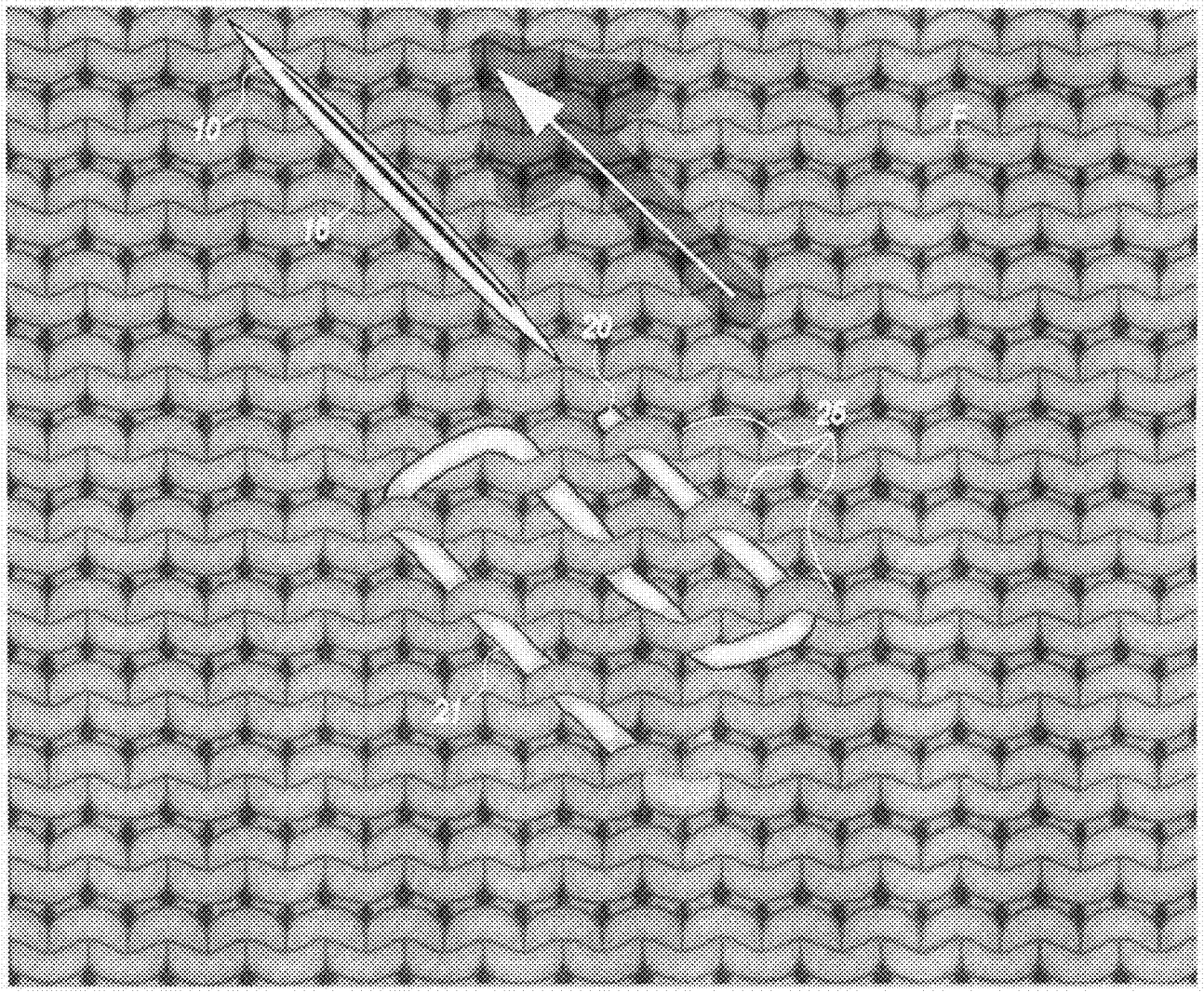

In FIG. 4I, the finishing needle 10 pulls the last remaining length of yarn 21 under the set of threads 25. In FIG. 4J, as the finishing needle 10 is pulled out from under threads 25, the loose end 20 of yarn 21 is completely woven into the threads 25 on the back side of the knitting project.

It should be understood that needle 10 is not limited to use with knitted products only. Needle 10 may be used in combination with, for example, handmade, hand-assembled or hand-embellished textiles, including crocheted, woven or knitted fabrics. Further, needle 10 is not limited to the exemplary size illustrated in the Figures, and may be dimensioned accordingly for use with other fabrics and projects, such as tapestries, cross-stitch projects, needlepoint, crewel work or embroidery.

It is to be understood that the present invention is not limited to the embodiment described above, but encompasses any and all embodiments within the scope of the following claims.

I claim:

1. A finishing needle, comprising an elongate body having a first and second end, the elongate body having a single axis extending between the first and second end, the first and second ends tapering to a semi-pointed shape, the elongate body having a single, continuous elongate eye defined therein extending continuously between the first and second ends along the single axis, the eye having a forward side and a back side proximate and adjacent the first and second ends of the elongate body, respectively, the eye extending substantially the length of the elongate body wherein the forward side has a beveled edge extending in the direction of the first end and the back side of the elongated eye has a beveled edge extending in the direction of the second end of the elongate body, whereby yarn may be easily threaded through the eye without breaking.

2. The finishing needle according to claim 1, wherein the forward side and the back side of the elongated eye are each substantially U-shaped.

3. The finishing needle according to claim 1, wherein the elongate body is symmetric about a transverse axis.

4. A method of using a finishing needle to finish a textile item, the method comprising the steps of:

providing a finishing needle, the finishing needle being elongated and having a forward side, a back side, a first end, an opposing second end, and an eye defined therein extending substantially the entire length of the needle between the opposing first and second ends, wherein the forward side has a beveled edge extending in the direction of the first end and the back side of the elongated eve has a beveled edge extending in the direction of the second end of the elongate body;

inserting a short end piece of yarn through the eye;

passing the first end of the finishing needle under several threads on a back of the textile item in the direction of the first end;

pulling the needle out an opposite side of the threads;

passing the second end of the finishing needle under several threads on the back of the textile item in the direction of the second end, whereby the end piece of yarn moves to the back side of the eye;

passing the first end of the finishing needle under several threads on the back of the textile item in the direction of the first end, whereby the end piece of yarn moves to the front side of the eye;

pulling the needle out the opposite side of the threads; and securing the end piece of yarn under the threads on the back of the textile item.

* * * * *